US011528780B2

(12) United States Patent
Chabach

(10) Patent No.: US 11,528,780 B2
(45) Date of Patent: Dec. 13, 2022

(54) HYBRID PRINTED HEATER WITH OPTIONAL PTC EFFECT

(71) Applicant: IEE INTERNATIONAL ELECTRONICS & ENGINEERING S.A., Echternach (LU)

(72) Inventor: Driss Chabach, Noertrange (LU)

(73) Assignee: IEE INTERNATIONAL ELECTRONICS & ENGINEERING S.A., Echternach (LU)

( * ) Notice: Subject to any disclaimer, the term of this patent is extended or adjusted under 35 U.S.C. 154(b) by 0 days.

(21) Appl. No.: 17/636,700

(22) PCT Filed: Aug. 14, 2020

(86) PCT No.: PCT/EP2020/072901
§ 371 (c)(1),
(2) Date: Feb. 18, 2022

(87) PCT Pub. No.: WO2021/032640
PCT Pub. Date: Feb. 25, 2021

(65) Prior Publication Data

US 2022/0272796 A1 Aug. 25, 2022

(30) Foreign Application Priority Data

Aug. 22, 2019 (LU) ..... LU101364

(51) Int. Cl.
*H05B 3/34* (2006.01)
*H05B 1/02* (2006.01)

(52) U.S. Cl.
CPC ..... *H05B 3/347* (2013.01); *H05B 1/0238* (2013.01); *H05B 2203/017* (2013.01); *H05B 2203/029* (2013.01)

(58) Field of Classification Search
CPC ..... H05B 3/347; H05B 3/34; H05B 3/342; H05B 3/0042; H05B 3/345; H05B 3/36;
(Continued)

(56) References Cited

U.S. PATENT DOCUMENTS 4,642,887 A 2/1987 Fredriksson
2002/0179595 A1 12/2002 Nagele
(Continued)

FOREIGN PATENT DOCUMENTS

JP 2021530094 A * 11/2021
WO WO-2008009389 A1 * 1/2008 ..... B60N 2/5685
(Continued)

OTHER PUBLICATIONS

International Search Report corresponding to International Application No. PCT/EP2020/072901, dated Oct. 21, 2020, 3 pages.
(Continued)

*Primary Examiner* — Shawntina T Fuqua
(74) *Attorney, Agent, or Firm* — Reising Ethington P.C.

(57) ABSTRACT

A method of producing an electric heating device, in particular for automotive application, includes steps of: cutting through a sheet of electrically highly conductive material of appropriate thickness for obtaining a predetermined line pattern having at least one electrically conductive line with electrically conductive bridge members interconnecting portions of the at least one electrically conductive line; depositing a layer of curable adhesive material onto a surface of a dielectric, planar, flexible carrier; placing the obtained line pattern onto the layer of adhesive material; curing the adhesive material below the line pattern with the exception of the adhesive material below the bridge members; cutting through each bridge member at all ends between portions of
(Continued)

the at least one electrically conductive line interconnected by the respective bridge member; and removing the cut bridge members.

12 Claims, 2 Drawing Sheets

(58) Field of Classification Search
CPC ... H05B 3/46; H05B 3/48; H05B 3/54; H05B 2203/017; H05B 2203/029; H05B 2203/02; H05B 2203/03; H05B 2203/004; H05B 2203/007; H05B 2203/014; H05B 2203/013; H05B 2203/016; H05B 1/0238; H05B 1/0236

See application file for complete search history.

(56) References Cited

U.S. PATENT DOCUMENTS

2003/0183620 A1* 10/2003 Wong ..... H05B 3/34
219/549
2006/0278631 A1 12/2006 Lee et al.

FOREIGN PATENT DOCUMENTS

WO 2013050621 A2 4/2013
WO 2015024909 A1 2/2015

OTHER PUBLICATIONS

Written Opinion corresponding to International Application No. PCT/EP2020/072901, dated Oct. 21, 2020, 5 pages.

* cited by examiner

HYBRID PRINTED HEATER WITH OPTIONAL PTC EFFECT

TECHNICAL FIELD

The invention relates to the technical field of electric heating, in particular for automotive applications. More specifically, the invention relates to electrical heating of vehicle interior parts such as steering wheels, arm rests, door panels, and so forth.

BACKGROUND

Electric heating devices employing one or more electric heating members are widely used in the automotive industry for providing passenger comfort, for instance by heating a vehicle compartment in general, and/or passenger seats, and/or arm rests, and/or panels. Electric heating devices having flexible and/or stretchable heater members are known to be employed in vehicle steering wheels for heating right after start-up of a vehicle engine at cold ambient conditions.

It is considered as one requirement for such electric heating devices that they should be unnoticeable to the vehicle user if not put into operation. Other requirements may be an as even as possible heat density during operation, for instance within a range of a few degrees ° C., in order to avoid hot spots that may become noticeable to the vehicle user, and also to avoid material fatigue by the occurrence of thermal stress. An ongoing requirement for such applications is of course that of miniaturization.

Despite an excellent capability for carrying high current density, these combined requirements generally rule out the use of conventional heating wires such as wires made from copper.

Striving to meet the requirement above, solutions have been proposed in the prior art that employ foil heater members, i.e. heater members having the appearance of a thin flexible foil or film.

For instance, international application WO 2015/024909 A1 describes a foil heater for a heating panel. The foil heater comprises a first and a second spiral resistive heating trace formed in a first and a second layer, respectively, that conforms to a flat or curved surface. The first and second spiral resistive heating trace may be manufactured by (rotary) screen printing, gravure printing, flexographic printing or inkjet printing of an electrically conductive ink, followed by a curing/sintering step. Each of the first and second resistive heating traces has a center and at least one outer extremity. An electrically insulating layer is arranged between the first and second layer. The electrically insulating layer comprises an opening that accommodates an electrical via, through which the first and second resistive heating traces are electrically contacted with each other. The foil heater is compatible with operation at lower temperature. Due to their spiral shape, the heating traces can be routed densely over the entire heating surface substantially without crossings. A significantly more uniform temperature distribution can thus be achieved.

Another approach has been taken by international application WO 2013/050621 A2, which describes electrically conductive textiles for occupant sensing and/or heating applications, wherein the sensor and/or heater can be attached from the backside to a surface such as a driver seat, a passenger seat, a backseat, a steering wheel, a door side of compartment, a gear shift lever, etc.

A flexible heater and/or electrode comprises a woven textile material having a warp direction and a weft direction. The textile material comprises at least one region having a low electrical conductance and at least two regions having a high electrical conductance. The at least two regions of high electrical conductance are adjacent to the at least one region of low electrical conductance. At least one of the at least two regions of high electrical conductance is operatively connected to a connection terminal of the heater and/or electrode, wherein the connection terminal serves for connecting the heater and/or electrode to an electronic control circuit.

Resistive heating traces made by (rotary) screen printing, gravure printing, flexographic printing or inkjet printing of an electrically conductive ink could be easily integrated close to a surface to be heated. Electrically resistive inks exhibiting a positive temperature coefficient (PTC), which is desirable as such materials are inherently self-limiting, are readily commercially available. However, their use for feed lines is limited as required sheet resistances are achievable only with inks having a high silver load. This has a large impact on cost efficiency and further results in a significant decrease of the mechanical robustness in terms of resistance to bending of the printed conductor path, as highly conductive silver inks are known to be mechanically fragile. Any compression, bending and/or elongation stress that may be applied by an operator during installation or, for instance by a seat occupant in case of a seat heating device, may compromise an electrical resistance of one or more resistive heater elements to increase due to formed cracks or fissures, resulting in a reduced heating power, up to an extent that may eventually lead to the electric heating device becoming non-operable.

SUMMARY

It is therefore desirable to provide an improved electric heating device, in particular for automotive applications.

In one aspect of the present invention, the object is achieved by a method of producing an electric heating device, in particular for automotive application, which includes at least the following steps:

- providing a sheet of electrically highly conductive material of appropriate thickness,
- cutting through the sheet for obtaining a predetermined line pattern comprising at least one electrically conductive line with electrically conductive bridge members interconnecting portions of the at least one electrically conductive line,
- providing a dielectric, planar, flexible carrier,
- depositing a layer of curable adhesive material onto a surface of the flexible carrier,
- placing the obtained line pattern onto the layer of adhesive material,
- curing the adhesive material below the line pattern with the exception of the adhesive material below the bridge members,
- cutting through each bridge member at all ends between portions of the at least one electrically conductive line interconnected by the respective bridge member, and
- removing the cut bridge members.

The term "automotive", as used in this patent application, shall particularly be understood as being appropriate for use in vehicles including passenger cars, trucks, semi-trailer trucks and buses.

The proposed method can enable a simple and cost-effective production of an electric heating device, in particular for automotive application, with an excellent capability for carrying high current density in electric feed lines that form part of the predetermined line pattern. The method allows for producing electric heating devices in which the electric heating member is based on serial circuitry, and in which the electric feed lines as well as the at least one electric heating member are made from the sheet of electrically highly conductive material. The bridge members, which are removed at the end of the production method, provide for better handling properties of the predetermined line pattern obtained after the step of cutting through the sheet or even makes its handling possible. Further, the method can enable a production of an electric heating device that can be integrated close to an outer surface of an object with a low visibility and tactility.

The step of curing the adhesive material may include illuminating if the adhesive material is light-curable. The step of curing the adhesive material may include applying a heat source to the line pattern for heating up the line pattern to a temperature above a curing temperature with the exception of the adhesive material below the bridge members if the adhesive material is thermally curable. In the latter case, the step of curing the adhesive material may also include rejecting heat from or active cooling of the bridge members.

The electrically highly conductive material may be selected from, without being limited to, copper, copper alloys such as brass, aluminum and electrically conductive textiles. The phrase "electrically conductive textile", as used in this application, shall in particular encompass textiles having a continuous layer of electrically conductive material attached to and covering at least a major part of at least one surface. The continuous layer of electrically conductive material may be attached to the at least one surface by applying a physical vapor deposition (PVD) method such as evaporation or sputtering, or may be attached galvanically by electroplating. An electric resistance of the continuous layer of electrically conductive material attached to, for instance, a surface of a textile can be adjusted by selecting a type of textile, a material for the electrically conductive material, and an applied conductive material area weight. This design freedom can allow to cover any heating power requirements of, for instance, a steering wheel heater device and a large range of other automotive electric heating device applications, such as a vehicle arm rest, vehicle door or dashboard panel heaters, and so forth.

The proposed method of producing an electric heating device can be employed in the field of building technology or in the field of printed circuit board (PCB) production technology, with the advantage of omitting etching processes, which can make PCB production more environmentally friendly.

In preferred embodiments, wherein the predetermined line pattern includes at least two electrically conductive lines, the method further comprises subsequent steps of depositing curable electrically resistive ink at a plurality of predetermined locations to be in electric contact with the at least two electrically conductive lines, and of curing the attached electric resistive ink for obtaining electrically resistive lines.

This embodiment of the method allows for producing electric heating devices having a plurality of electric heating members based on serial circuitry of the obtained electrically resistive lines, and in which the electric feed lines are made from the sheet of electrically highly conductive material, exhibiting excellent capability for carrying high current density.

Preferably, the step of depositing curable electrically resistive ink includes applying a screen printing or an ink jet printing process. The application of these high-precision, cost-effective manufacturing methods can facilitate low manufacturing tolerances, in particular for dimensions in the direction perpendicular to the surface of the planar flexible carrier, which can enable uniform heating, and a high reliability of the plurality of electric heating members.

In preferred embodiments, the method further comprises a subsequent step of depositing a continuous dielectric protection layer as a top layer, covering the electrically conductive line or lines and, if applicable, the electrically resistive lines. In this way, an electric heating device with large reliability and long lifetime can be produced.

Preferably, the step of cutting through each bridge member at all ends comprises applying a kisscut process or a laser cutting process. By that, the step of cutting can be executed in an effective and reliable manner.

In preferred embodiments of the method, the step of cutting through the sheet for obtaining a predetermined line pattern includes obtaining a subset of the bridge members that interconnect portions of the at least one electrically conductive line or another bridge member or bridge members from an outside direction. In this way, handling properties of the predetermined line pattern that is obtained after the step of cutting through the sheet can further be improved.

In another aspect of the invention, a pre-stage of an electric heating device, in particular for automotive application, is provided. The pre-stage of an electric heating device comprises a dielectric, planar, flexible carrier and a predetermined line pattern. The predetermined line pattern includes at least one electrically conductive line and a plurality of electrically conductive bridge members that interconnect portions of the at least one electrically conductive line. Only the electrically conductive line is or the electrically conductive lines are fixedly attached to a surface of the flexible carrier by a layer of adhesive material.

The proposed electric heating device can have an excellent capability for carrying high current density in electrically conductive lines designed as electric feed lines that form part of the predetermined line pattern. The proposed pre-stage of an electric heating device can readily be turned into an operable state by cutting through both ends of each bridge member and removing the cut bridge members.

The electrically conductive lines designed as electric feed lines can serve for connecting ends of at least one electrically conductive line, designed as an electrically resistive line (in the following also briefly referred to as electrically resistive line) to serve as a heating member, with an electric power source.

Preferably, the predetermined line pattern has a thickness that ranges between 5 μm and 100 μm. By that, a capability for carrying high current density in electrically conductive lines designed as electric feed lines can be achieved that allows to cover a major part of requirements from automotive applications.

In preferred embodiments of the pre-stage of the electric heating device, the predetermined line pattern includes a plurality of electrically conductive lines and a plurality of electrically resistive lines that are electrically connected in parallel by the plurality of electrically conductive lines. By that, an excellent capability for carrying high current density in electrically conductive lines designed as electric feed lines can advantageously be combined with uniform heating properties due to the plurality of electrically resistive lines.

Preferably, the electrically resistive line comprises or the electrically resistive lines comprise at least one out of carbon black, graphite, graphene, an electrically conductive textile or a material that has an electrical resistivity with a positive temperature coefficient. In this way, an effective heating function of the electrically resistive line or the electrically resistive lines can be ensured. If a material with a positive temperature coefficient resistivity is employed the electrically resistive line or the electrically resistive lines can be laid out to be self-limiting.

In preferred embodiments of the pre-stage of the electric heating device, the flexible carrier is formed by a foil that is made for the most part from a plastic material that is selected from a group of plastic materials formed by polyethylene terephthalate (PET), polyimide (PI), polyetherimide (PEI), polyethylene naphthalate (PEN), polyoxymethylene (POM), polyamide (PA), polyphthalamide (PPA), polyether ether ketone (PEEK), thermoplastic polyurethane (TPU) and combinations of at least two of these plastic materials.

The term "for the most part", as used in this application, shall particularly be understood as equal to or more than 50%, more preferably more than 70%, and, most preferably, more than 80% in volume, and shall encompass a part of 100%, i.e. the planar flexible carrier foil is completely made from the selected plastic material or materials, respectively.

These plastic materials can allow for easy manufacturing, and durable, cost-efficient electrically insulating sheets of low manufacturing tolerances can be provided as a basis for the planar flexible carrier foil.

Preferably, the planar flexible carrier is stretchable, and the predetermined line pattern includes stretchable electrically conductive textile. The term "stretchable", as used in this application, shall be understood such that the planar flexible carrier can be stretched by an operator during installation or by a user of the electric heating device, for instance a vehicle seat occupant, by an amount between 1% and 3%, preferably up to 4%, and, most preferably, up to 5% of a mechanically unloaded extension length. By employing a stretchable planar flexible carrier foil, the flexible electric heating device can be used with particular advantage in applications with large surface curvature such as a vehicle steering wheel. In such applications, the at least one electric heating member can be installed in a manner that is adapted to a high extent to a surface contour of an object to be heated (3D integration), and an excellent heat transfer to the object can be enabled. Electrically conductive textile materials are available in a large variability, and vast experience exists regarding mechanical properties and production methods. Thus, appropriate materials can be selected from a large pool in order to meet existing application requirements.

These and other aspects of the invention will be apparent from and elucidated with reference to the embodiments described hereinafter.

It shall be pointed out that the features and measures detailed individually in the preceding description can be combined with one another in any technically meaningful manner and show further embodiments of the invention. The description characterizes and specifies embodiments of the invention in particular in connection with the figures.

BRIEF DESCRIPTION OF THE DRAWINGS

Further details and advantages of the present invention will be apparent from the following detailed description of not limiting embodiments with reference to the attached drawing, wherein.

DETAILED DESCRIPTION

Figure 1:
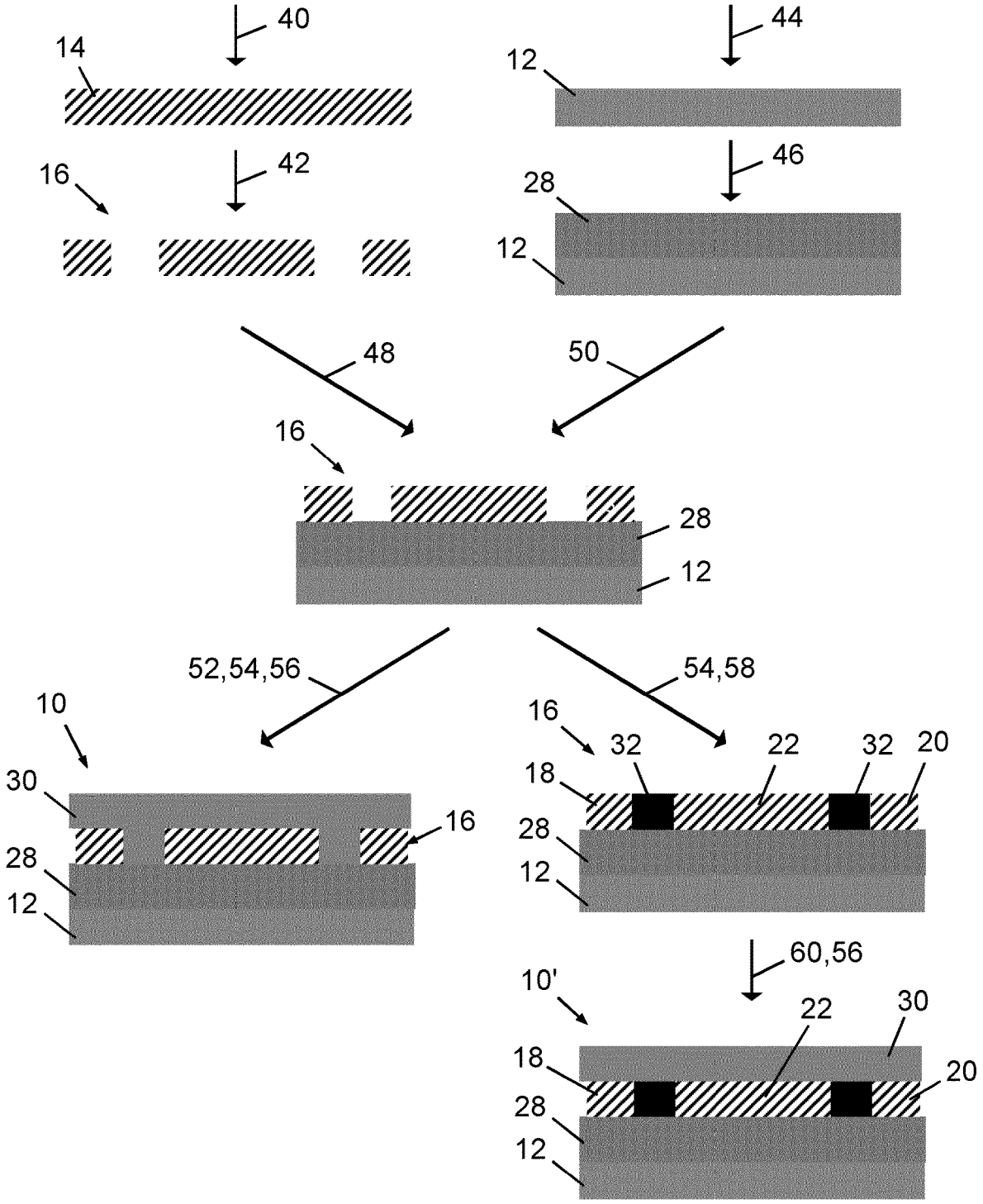
FIG. 1 illustrates steps of a method in accordance with the invention of producing an electric heating device in a sectional side view, and FIG. 2 schematically shows a detail of a pre-stage of an electric heating device in accordance with the invention in a plan view.

FIG. 1 illustrates steps of two possible embodiments of a method in accordance with the invention of producing an electric heating device 10, 10' which is intended to be used in an automotive application, for instance for automatically heating a vehicle steering wheel right after start-up at cold ambient conditions. A detail of a pre-stage of the electric heating device 10 is schematically shown in FIG. 2.

The pre-stage of the electric heating device 10 comprises a dielectric, planar, flexible carrier 12, formed by a foil, which can be made for the most part or completely from polyethylene terephthalate (PET). In other embodiments, the flexible carrier 12 can also be stretchable and can for instance be made from a 25 μm polyimide foil. With a width of 40 mm, such polyimide foil can be stretched by an amount of 5% by applying a force of about 90 N.

The pre-stage of the electric heating device 10 further includes a predetermined line pattern 16. The predetermined line pattern 16 comprises an electrically conductive line 22 to serve as an electric heating member and at least two electrically conductive lines designed as electrically highly conductive feed lines 18, 20 (in the following also briefly referred to as feed lines) that are electrically connected to ends of the electrically conductive line 22. Further, the pre-stage of the electric heating device 10 includes a plurality of electrically conductive bridge members 24, 26 by which portions of the electrically conductive line 22 are interconnected. A subset 26 of the plurality of bridge members 24, 26 interconnect portions of other bridge members 24 from an outside direction, i.e. in a frame-like manner.

Figure 2:
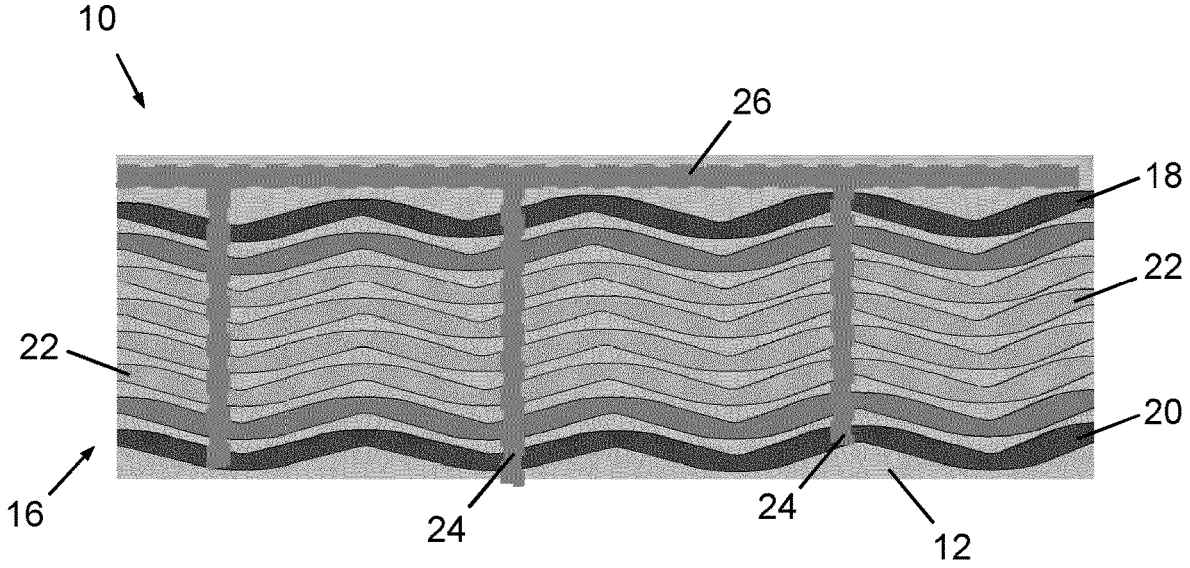

In FIG. 2, the two electrically highly conductive feed lines 18, 20 are shown as undulated lines disposed along longer side edges of the flexible carrier 12. The electrically conductive line 22 arranged between the feed lines 18, 20 is continued such that each feed line 18, 20 is connected to the adjacent portion of the electrically conductive line 22, and the portions of the electrically conductive line 22 are alternately connected so as to form a meander (not shown). The electrically conductive line 22 has a much smaller width than the feed lines 18, 20 (FIG. 2 is not to scale) to generate a heating effect mainly in the electrically conductive line 22 when the electric heating device 10 is energized.

In the following, two possible embodiments of the method in accordance with the invention will be described with reference to FIGS. 1 and 2. In one step 40 of the method, a sheet 14 of electrically highly conductive material of appropriate thickness is provided. The sheet 14 can be formed by a copper sheet, and its thickness can range between 5 μm and 100 μm. In this specific embodiment, the copper sheet thickness is 40 μm.

In another step 42 of the method, the sheet 14 is cut through for obtaining the predetermined line pattern 16. The cutting process can for instance be performed by employing a die or by using a laser cutting process. In a step 44 of the method that can be carried out in parallel or subsequently, a dielectric, planar, flexible and stretchable carrier 12, which is formed by a 25 μm polyimide foil of rectangular shape, is provided. In a next step 46, a layer of curable adhesive material 28 is deposited onto a surface of the flexible carrier 12. The adhesive material 28 can for instance be applied by a coating or printing process or by distributing the adhesive as powder.

The predetermined line pattern 16 is placed onto the layer of adhesive material 28 in another step 48. This step 48 is greatly facilitated or even made possible by the presence of the plurality of bridge members 24, 26 (FIG. 2). In the next step 50 then (FIG. 1), the adhesive material 28 below the line pattern 16 is cured with the exception of the adhesive material 28 below the bridge members 24, 26. To this end, the line pattern 16 except for the bridge members 24, 26 can be heated up to a temperature above the curing temperature of the adhesive material 28, or the adhesive material 28 below the line pattern 16 except for the bridge members 24, 26 can be illuminated, depending on the type of adhesive material 28. After this step 50, which completes the pre-stage of the electric heating device 10, the line pattern 16 is fixedly attached to the flexible carrier 12 with the exception of the bridge members 24, 26, which lie loosely on the adhesive material 28.

The pre-stage can be made in two more steps 52, 54 to the finished electric heating device 10. In one of the steps 52, each bridge member 24, 26 is cut through at all ends between portions of the electrically conductive lines 22 and the feed lines 18, 20 interconnected by the respective bridge member 24, 26. This step 52 can include applying a kisscut-process or a laser cutting process. In the other step 54, the cut bridge members 24, 26 are removed.

In principle, the electric heating device 10 is finished at this stage. For better protection against outer influences and for improving reliability and lifetime, an additional, subsequent step 56 of depositing a continuous dielectric protection layer 30 as a top layer, covering the electrically conductive line lines 22 and the feed lines 18, 20, can be carried out. As a material for the protection layer 30, for instance acrylic adhesive, rubber or polyurethane can be employed, but also other materials that appear to be suitable to those skilled in the art can be used.

In an alternative embodiment of the pre-stage of the electric heating device 10', only one undulated electrically conductive line 22 instead of six portions forming a meander is arranged between the two electrically highly conductive feed lines 18, 20, which also serves as a feed line (return line) and is running parallel to the side edges of the flexible carrier 12.

The alternative embodiment of the pre-stage of the electric heating device 10' further includes a plurality of electrically conductive lines that are designed as electrically conductive heater lines and are connected in parallel by the two feed lines 18, 20 and the return line 22. The electrically conductive heater lines comprise a carbon black material having an electrical resistivity with a positive temperature coefficient (PTC).

For producing the alternative embodiment of the pre-stage of the electric heating device 10', the method further comprises steps to be carried out after the step 54 of removing the cut bridge members 24, 26.

In one 58 of these steps, curable electrically resistive ink 32 is deposited at a plurality of predetermined locations to be in electric contact with at least two electrically conductive lines 18, 20, 22, i.e. with one of the two feed lines 18, 20 and with the return line 22. The step 58 of depositing curable electrically resistive ink 32 can be executed by applying a screen printing or an ink jet printing process.

This step 58 is followed by a step 60 of curing the attached electric resistive ink 32 for obtaining the electrically conductive heater lines. An additional, subsequent step 56 of depositing a continuous dielectric protection layer 30 as a top layer, covering the electrically conductive lines 18, 20, 22 as well as the electrically conductive heater lines can be carried out.

While embodiments of the invention have been illustrated and described in detail in the drawings and foregoing description, such illustration and description are to be considered illustrative or exemplary and not restrictive; the invention is not limited to the disclosed embodiments.

Other variations to be disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality, which is meant to express a quantity of at least two. The mere fact that certain measures are recited in mutually different dependent claims does not indicate that a combination of these measures cannot be used to advantage. Any reference signs in the claims should not be construed as limiting scope.

The invention claimed is:

1. A method of producing an electric heating device for automotive application, including at least the following steps:

providing a sheet of electrically highly conductive material of appropriate thickness, obtaining a predetermined line pattern by cutting through the sheet, the predetermined line pattern comprising at least one electrically conductive line with electrically conductive bridge members interconnecting portions of the at least one electrically conductive line, providing a dielectric, planar, flexible carrier, depositing a layer of curable adhesive material onto a surface of the flexible carrier, placing onto the layer of adhesive material, curing the adhesive material below the line pattern with the exception of the adhesive material below the bridge members, cutting through each bridge member at all ends between portions of the at least one electrically conductive line interconnected by the respective bridge member, and removing the cut bridge members.

2. The method as claimed in claim 1, wherein the predetermined line pattern includes at least two electrically conductive lines, and the method further comprises subsequent steps of depositing curable electrically resistive ink at a plurality of predetermined locations to be in electric contact with the at least two electrically conductive lines and of curing the attached electric resistive ink for obtaining electrically resistive lines.

3. The method as claimed in claim 2, wherein the step of depositing curable electrically resistive ink includes applying a screen printing or an ink jet printing process.

4. The method as claimed in claim 1, further comprising a subsequent step of depositing a continuous dielectric protection layer as a top layer, covering the electrically conductive line or lines and, if applicable, the electrically resistive lines.

5. The method as claimed in claim 1, wherein the step of cutting through each bridge member at all ends comprises applying a kisscut process or a laser cutting process.

6. The method as claimed in claim 1, wherein the step of cutting through the sheet for obtaining a predetermined line pattern includes obtaining a subset of the bridge members that interconnect portions of the at least one electrically conductive line or other bridge members from an outside direction.

7. A pre-stage of an electric heating device for automotive application, comprising:

a dielectric, planar, flexible carrier, and a predetermined line pattern including at least one electrically conductive line, and a plurality of electrically conductive bridge members interconnecting portions of at least one electrically conductive line, wherein only the at least one electrically conductive line is fixedly attached to a surface of the flexible carrier by a layer of adhesive material.

8. The pre-stage of the electric heating device as claimed in claim 7, wherein the predetermined line pattern has a thickness between 5 μm and 100 μm.

9. The pre-stage of the electric heating device as claimed in claim 7, wherein the predetermined line pattern includes a plurality of electrically conductive lines and a plurality of electrically resistive lines that are electrically connected in parallel by the plurality of electrically conductive lines.

10. The pre-stage of the electric heating device as claimed in claim 7, wherein the electrically resistive line comprises or the electrically resistive lines comprise at least one out of carbon black, graphite, graphene, an electrically conductive textile or a material that has an electrical resistivity with a positive temperature coefficient.

11. The pre-stage of the electric heating device as claimed in claim 7, wherein the flexible carrier is formed by a foil that is made for the most part from a plastic material that is selected from a group of plastic materials consisting of: polyethylene terephthalate PET, polyimide PI, polyetherimide PEI, polyethylene naphthalate PEN, polyoxymethylene POM, polyamide PA, polyphthalamide PPA, polyether ether ketone PEEK, thermoplastic polyurethane TPU, and combinations of at least two of these plastic materials.

12. The pre-stage of the electric heating device as claimed in claim 7, wherein the flexible carrier is stretchable, and the predetermined line pattern comprises stretchable electrically conductive textile.

* * * * *